United States Patent [19]

Noren

[11] 4,145,002

[45] Mar. 20, 1979

[54] ROTARY SPRAY MANIFOLD

[76] Inventor: Tore H. Noren, 3200 Lakeville Hwy., Petaluma, Calif. 94952

[21] Appl. No.: 763,814

[22] Filed: Jan. 31, 1977

[51] Int. Cl.[2] ..... B05B 15/02

[52] U.S. Cl. ..... 239/110; 239/244

[58] Field of Search ..... 239/110, 261, 101, 262, 239/220, 227, 244, 251, 259; 134/186, 187

[56] References Cited

U.S. PATENT DOCUMENTS

| | | | |
|---|---|---|---|
| 1,952,236 | 3/1934 | Clawson | 239/110 |
| 2,637,595 | 5/1953 | Fox et al. | 239/244 |
| 2,780,492 | 2/1957 | Stine | 239/110 |
| 2,905,393 | 9/1959 | Federighi et al. | 239/110 |
| 3,125,297 | 3/1964 | Copeland et al. | 239/261 |

*Primary Examiner*—James B. Marbert

*Attorney, Agent, or Firm*—William R. Piper

[57] ABSTRACT

A rotatable spray manifold especially designed for a commercial dishwasher and in which the ends of the two hollow arms are closed by cleanout-caps, each cap being carried by a pair of rods that straddle the sides of each elongated arm and are pivotally secured thereto. The pair of rods form a frame that can swing the cap from closing the open end of the hollow arm into uncovering it, thus permitting access to the interior of each arm for cleaning the spray manifold. The cap is adjustably carried by the swingable frame so as to be movable into a water tight contact with the open end of the spray arm. No tools are necessary to be used in the opening or closing movement of the cleanout-cap and the cap cannot accidentally become lost.

4 Claims, 11 Drawing Figures

ROTARY SPRAY MANIFOLD

SUMMARY OF THE INVENTION

An object of my invention is to provide a rotatable spray manifold having radially extending hollow arms whose open ends are closed by removable cleanout caps. Each cap is adjustably supported by a pair of rods forming a swingable frame which in turn is pivotally connected to the arms so that the frame can swing the cap from open position, where it uncovers the open end of the hollow arm, into closed position where the cap can be adjusted for closing the open end of the arm.

A further object of my invention is to provide a rotatable spray manifold whose central rotatable support includes a sleeve whose axis coincides with the axis of rotation. The sleeve is fixed to the center of the spray manifold and rotates about a cylindrical bearing. Both the bearing and sleeve have openings in their cylindrical walls that successively register with each other as the sleeve rotates about the bearing. This arrangement will give a pulsating effect to the hot water as it flows from the interior of the hollow bearing and through the openings in the bearing and sleeve and into the hollow spray arms. The result is a pulsating flow of water which issues from the spray jets mounted on the spray arms and communicating with the water in the spray arms. The spray jets have their outlet orifices inclined from the vertical about 18° in order to impart a rotating motion to the spray manifold as the pulsating hot water issues from the spray jets.

DESCRIPTION OF THE PREFERRED EMBODIMENTS

Figures 1, 2, 3, 4, 5, 6:
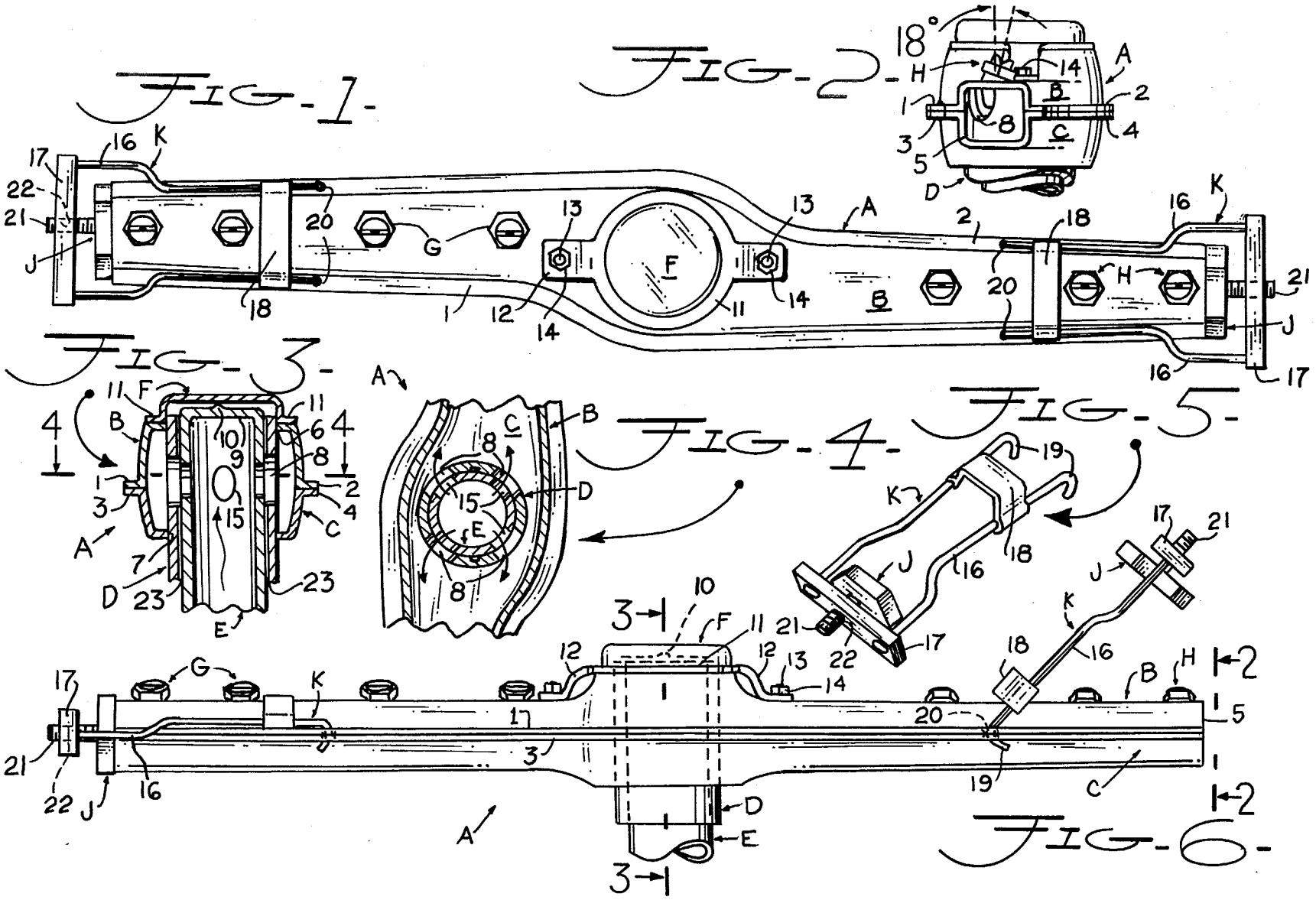
FIG. 1 is a top plan view of a lower rotatable spray manifold.
FIG. 2 is a view when looking at the open right hand end of the rotatable spray manifold as indicated by the arrows 2—2 in FIG. 6. The cleanout cap for closing the open end of the manifold spray arm is not shown.
FIG. 3 is a vertical section of the rotatable spray manifold and its associate supporting parts and it is taken along the line 3—3 of FIG. 6.
FIG. 4 is a horizontal section taken along the line 4—4 of FIG. 3.
FIG. 5 is a perspective view of the cleanout cap and its supporting frame.
FIG. 6 is a front elevation of FIG. 1 and shows the right hand cleanout cap and its supporting frame swung into an open position so as to uncover the right hand end of the hollow arm of the rotatable spray manifold to permit access to the interior of the arm for cleaning purposes.

In carrying out my invention, I provide a rotatable spray manifold, indicated generally at A in FIGS. 1 and 6, and formed from two stamped out parts, an upper part B, and a lower part C, see also FIG. 2. The upper part B has laterally extending side flanges 1 and 2 while the lower part C has two laterally extending flanges 3 and 4. The flanges 1 and 3 are brought into abutting relation and spot welded together and also the flanges 2 and 4 are brought into abutting relation and spot welded so as to form two diametrically opposed and radially extending hollow arms with open ends. The open end 5 of one of the hollow arms is shown in FIGS. 2 and 6.

The central portion of the spray manifold A is enlarged slightly and the upper and lower parts B, and C, thereof have aligned openings 6 and 7, respectively, see FIG. 3, whose axes coincide with the axis of rotation for the spray manifold. A sleeve D, is press fitted in the aligned openings 6 and 7 in the manifold A so as to make a liquid tight fit. The sleeve will rotate as a unit with the manifold. It will be seen from FIG. 3, that the top of the sleeve D extends a slight distance above the top of the upper part B of the spray manifold and the sleeve bottom extends a slight distance below the bottom part C. Also, the sleeve has a plurality of openings 8 in its cylindrical wall that open into the interior of the rotatable spray manifold.

Figures 7, 8, 9, 10, 11:
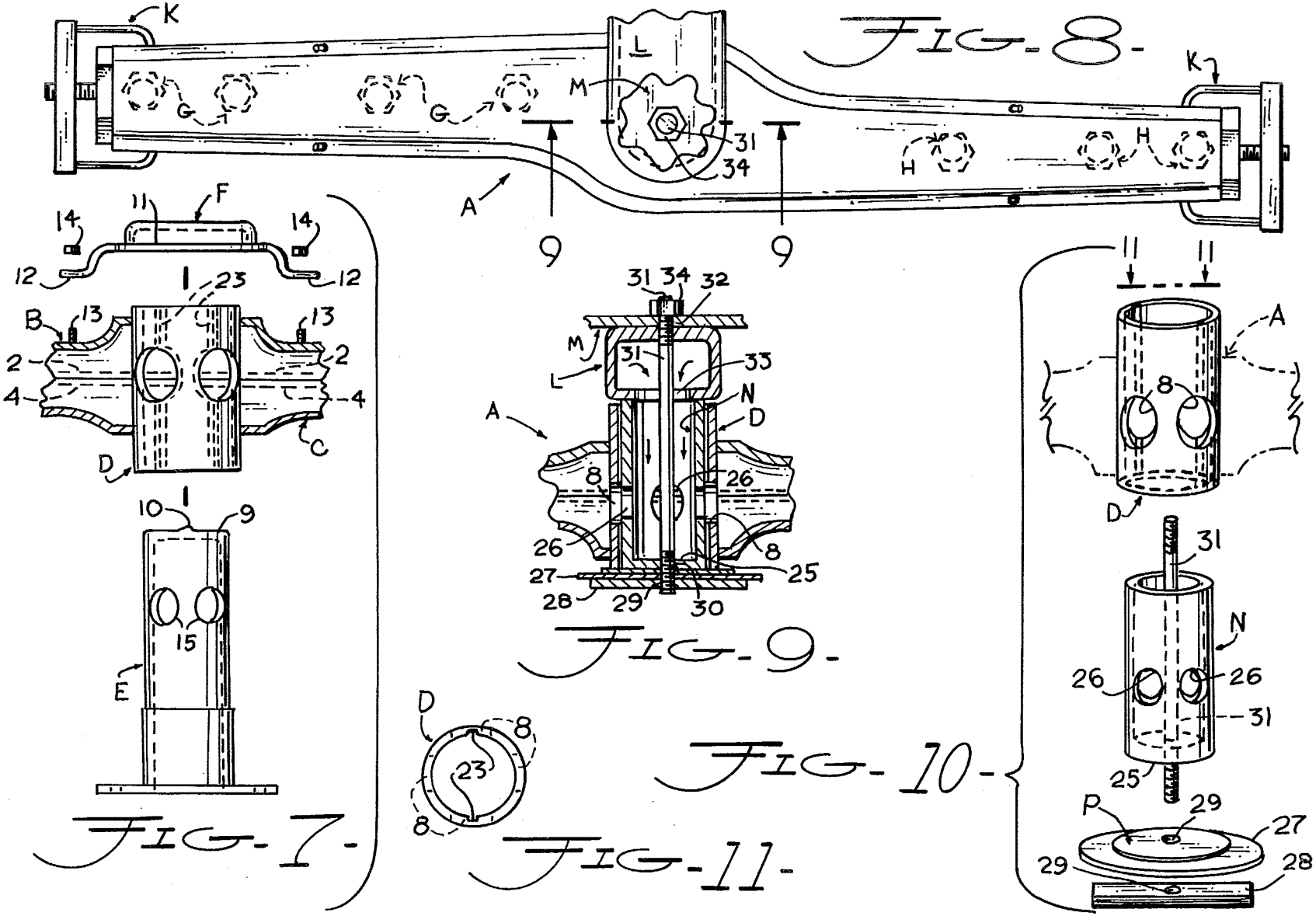
FIG. 7 is an exploded view of the parts for rotably supporting the spray manifold.
FIG. 8 is a top plan view of the upper rotatable spray manifold which is identical to the upper one. This spray manifold is shown turned upside down so that the spray jets will be pointing downwardly instead of upwardly.
FIG. 9 is a vertical section taken along the line 9—9 of FIG. 8.
FIG. 10 is an exploded view of the parts for rotatably supporting the upper spray manifold.
FIG. 11 is a top plan view of the sleeve which supports the spray manifold and illustrates the longitudinally extending grooves on its inner surface that function as wiping grooves for removing and washing away any foreign matter collecting between the sleeve and its inner supporting bearing.

The means for delivering hot water into the interior of the spray manifold A, is shown in FIGS. 3 and 7. A hot water inlet pipe E for the dishwasher is illustrated in the exploded view of FIG. 7. This pipe has a closed top 9, shown in section in FIG. 3, and the outer surface of this closed top has a central rounded knob 10 that rotatably supports the spray manifold in a manner now to be described. FIGS. 1, 6 and 7, show a cover F for the top of the sleeve D, and this cover has an annular flange 11, contacting the top of the upper spray manifold part B. The cover also has diametrically extending projections 12 that are secured to the upper part B, by upstanding threaded studs 13, integral with the upper part B, and nuts 14. The center of the cover F, contacts the knob 10 and the spray manifold A, is rotatably supported in this manner. The weight of the manifold is sufficient to overcome any lifting force exerted by the flow of hot water from the inlet pipe E, and into the interior of the manifold.

The hot water inlet pipe E has a cylindrical portion functioning as a bearing and a plurality of openings 15 are provided in the bearing wall which intermittently register with the openings 8 in the rotating sleeve D, as the spray manifold A, rotates, see FIG. 3. The manifold has four spray jets G, in the left hand arm in FIG. 1, and three spray jets H. The spray jets G have their outlet orifices inclined about 18° from vertical and the jets H, have their orifices inclined about 18° from the vertical and in an opposite direction from the jets G. The result is that the pulsating hot water, caused by the openings 8 in the rotating sleeve D, passing through the openings 15 in the inlet pipe E, will rotate the spray manifold in a clockwise direction when looking at FIG. 1, see also FIG. 2.

I will now set forth a very important feature of the rotatable spray manifold A, and that is the novel way of providing a removable cleanout cap J, adjustably mounted on a swingable frame K, that cannot be removed from the spray arm, see FIGS. 1, 5 and 6. The frame K, is formed by a pair of spaced apart rods 16 that are interconnected at their outer ends by a strap 17 and are interconnected near their inner ends by a U-shaped member 18 that also functions as a stop when the cleanout cap J registers with the adjacent open end of the spray manifold arm. The inner ends of the pair of rods 16 are bent at 19 and are pivotally received in openings 20 formed in the laterally extending flanges of the spray arms. The bent ends 19 of the rods 16 permit the swinging of the frame K from closed position, shown at the left hand end of FIG. 6, into open position as shown at the right hand end of the same Figure. When the frame K reaches its closed position, the U-shaped cross member 18 will contact the top of the manifold A and will stop any further swinging movement of the frame in the same direction.

The cleanout cap J, preferably has a non-circular periphery so that it may be manually gripped and rotated about its center. FIG. 5, shows the cap with a centrally disposed threaded stud 21 that is received in a center threaded opening 22 in the strap 17. The cap can be manually rotated for rotating the stud in the threaded opening 22 for moving the cap toward or away from the adjacent open end of the manifold arm when the frame K is in closed position as indicated at the left hand end of FIG. 6. In actual practice, when the operator wishes to uncover an end of the manifold arm for cleaning the manifold interior, he first rotates the cap J to free it from its closed position and for clearing the adjacent open end of the manifold arm and then swings the frame K, upwardly into an inoperative position. The two frames K are identical and a description of one will suffice for both and like reference characters will be applied to corresponding parts.

The sleeve D, has a pair of longitudinally extending wiping grooves 23 formed on its inner cylindrical surface, see FIG. 7. A top plan view of the sleeve D, is shown in FIG. 11 where the grooves 23 are clearly shown. The bent ends 19 of the rods 16 permit the frame K to be swung from closed to open position and vice versa, but prevent the frame from being entirely removed from the spray manifold. This prevents the cleanout cap J from becoming misplaced or lost.

The same rotary spray manifold A can also be used as an upper spray manifold in a commercial dishwasher and I show such an arrangement in FIGS. 8 to 11, inclusive. In order to save in a further description of the spray manifold, which I have already described, like reference characters will be applied to similar parts and I will only show and describe the different structure to make the rotary spray manifold A adaptable to function as an overhead spray manifold.

FIG. 8 shows the rotary spray manifold A turned upside down so that the spray jets G, and H, are pointing downwardly instead of upwardly. The frames K with their cleanout caps J, are swung downwardly to remove the caps from the ends of the spray manifold A so that the interior of the manifold may be cleaned.

FIG. 9 illustrates how the upper spray manifold A with its sleeve D is rotatably connected to a hot water pipe L, in a commercial dishwasher. The top of the dishwashing compartment is indicated by a portion of a horizontal wall M. A cylindrical bearing N has an open top, see FIG. 10, and a closed bottom 25. This bearing has a plurality of openings 26 in its cylindrical wall. The sleeve D for the upper spray manifold A, telescopes over the bearing N so that its openings 8 will successively register with the openings 26 in the bearing as the spray manifold and sleeve rotate about the bearing as clearly indicated in FIG. 9.

The bearing N and the sleeve D of the upper spray manifold A are supported by an anti-friction gasket P, as shown in FIGS. 9 and 10. The gasket rests on a disc 27 which in turn has a rectangular strip 28 welded to its undersurface. A threaded central opening 28 extends through both disc 27 and through strip 28, and also through the anti-friction gasket P. The bottom 25 of the bearing N also has a threaded opening 30 which is aligned with the threaded opening 29 so that a spray arm supporting rod 31 has its threaded lower end received in the aligned threaded openings 30 and 29. Then the upper threaded end of the rod 31 is received in a threaded opening 32 provided in the top wall or plate M. The rod 31 extends through a large outlet opening 33 in the hot water inlet pipe L.

It will be seen from this arrangement of parts that the lower threaded end of the rod 31 can be secured to the bottom 25 of the bearing 30 and the anti-friction gasket P can be brought up tight against the bottom 25 and will rotatably support the sleeve D with its spray manifold A. The disc 27 and the strip 28 function as a lock nut for holding the gasket P, in place. The length of the bearing N is slightly longer than the length of the sleeve D so when the top of the bearing abuts the underside of the hot water inlet pipe L, in order to make a liquid tight connection between the two, there will be no binding action on the ends of the sleeve D, and therefore the sleeve will be free to rotate about the bearing and the sleeve will ride on the anti-friction gasket P. The threaded top of the rod 31 that extends above the threaded opening 32 in the wall M may have a lock nut 34 threaded thereon to secure the rod to the top wall. I have described one manner of rotatably supporting the spray manifold A so as to function as a top spray manifold.

The operation of the upper spray manifold A will be the same as for the lower spray manifold. The hot water will flow from the inlet pipe L, and will enter the interior of the cylindrical bearing N. From here the hot water will flow through the holes 26 and out through the holes 8 in the sleeve D as the latter register therewith. The hot water will issue as a spray from the jets G, and H, in a pulsating manner because as the spray manifold A revolves around the bearing N, the openings 8 in the sleeve 8 will successively register with the stationary openings 26 in the bearing. The hot water will therefore intermittently flow from the bearing interior into the manifold interior and will cause a pulsating hot water spray to issue from the jets.

I claim:

1. A spray manifold having at least one hollow elongated arm with an open outer end:

(a) a cleanout gap adapted to close the open end of said arm;

(b) a frame supporting said cap and being pivotally connected to said arm so as to swing said cap from closed to open position for permitting the cleaning of the interior of the hollow arm;

(c) said frame including a pair of spaced apart and substantially parallel rods that straddle the sides of said elongated arm, the inner ends of said rods being pivotally connected to said arm and the outer ends having a cross strap interconnecting them;

(d) means adjustably connecting said cleanout cap to said strap for permitting the cap to be moved into and out of contact with the open end of said elongated arm when said frame has swung its strap into spaced registration with the open end; and (e) a cross member extending between said arms and connected thereto, said cross member contacting said arm when said frame has swung said strap into spaced registration with the open end of said arm.

2. The combination as set forth in claim 1: and in which (a) said adjustable means connecting said cap to said strap includes a threaded stud extending axially from the center of the outer cap surface, said stud being adjustably received in a threaded opening in said strap;

(b) whereby said cap can be manually rotated after the axis of said stud is aligned with the axis of said arm for rotating the stud for moving said cap toward said arm for closing the open end or vice versa.

3. A rotatable spray manifold having a hollow interior;

(a) a cylindrical sleeve centrally mounted in said manifold and having openings in its cylindrical wall communicating with the interior of said manifold;

(b) a cylindrical hollow bearing disposed within and contacted by said sleeve and around which said sleeve and manifold revolve, said bearing having openings in its cylindrical wall adapted to successively register with the openings in said sleeve as the sleeve and manifold rotate about said bearing; and (c) means for feeding a fluid into the interior of said hollow bearing for causing this fluid to flow through the openings in said bearing and said sleeve when the openings register with each other;

(d) whereby a pulsating flow of fluid will be delivered to the interior of said manifold;

(e) said manifold having spray jets for spraying the fluid at an angle to the common axis of the bearing and sleeve for causing the manifold to rotate about said axis.

4. A spray manifold having at least one hollow elongated arm with an open outer end and a smooth non-threaded interior surface:

(a) a cleanout cap adapted to close the open end of said arm;

(b) a non-slidable frame having means for supporting said cap, said frame being pivotally connected to said arm so as to swing said cap laterally with respect to the longitudinal axis of said elongated arm from closed to open position so as to expose the entire open outlet end of said arm and to expose the entire unobstructed interior for permitting the unobstructed cleaning of the interior of the hollow arm;

(c) a stop member carried by said pivoted frame and adapted to contact said arm when the frame is manually swung into closed position to align the center of said cap with the longitudinal axis of said arm; and (d) said means including a threaded stud integral with said cap and whose axis is normal to the plane of said cap and intersects the center of the cap, said stud having a threaded connection with a threaded bore in said frame so that after said stop member contacts said arm for aligning the stud axis with the arm axis, said cap and stud can be rotated for moving said cap against the open end of said arm for sealing the open end.

* * * * *